US006682206B1

(12) United States Patent
David

(10) Patent No.: US 6,682,206 B1
(45) Date of Patent: Jan. 27, 2004

(54) ILLUMINATING SPOTLIGHT PROJECTOR AND LIGHTING INSTALLATION WITH OFFSET LIGHT SOURCE

(75) Inventor: Francis David, Sotteville (FR)

(73) Assignee: FD Eclairage, St.-Lubin des Joncherets (FR)

( * ) Notice: Subject to any disclaimer, the term of this patent is extended or adjusted under 35 U.S.C. 154(b) by 0 days.

(21) Appl. No.: 10/049,679

(22) PCT Filed: Aug. 10, 2000

(86) PCT No.: PCT/FR00/02290

§ 371 (c)(1),
(2), (4) Date: May 29, 2002

(87) PCT Pub. No.: WO01/14791

PCT Pub. Date: Mar. 1, 2001

(30) Foreign Application Priority Data

Aug. 19, 1999 (FR) ..... 99 10628

(51) Int. Cl.[7] ..... F21V 14/00

(52) U.S. Cl. ..... 362/255; 362/307; 362/308; 362/310; 362/328; 362/329

(58) Field of Search ..... 362/255, 307, 362/308, 310, 328, 329; 240/106.1; 176/34

(56) References Cited

U.S. PATENT DOCUMENTS

| | | | | |
|---|---|---|---|---|
| 2,254,961 A | 9/1941 | Harris | ..... | 240/106.1 |
| 2,362,171 A | 11/1944 | Swanson | ..... | 176/34 |
| 4,373,178 A | 2/1983 | Gulliksen | ..... | 362/280 |

FOREIGN PATENT DOCUMENTS

| | | | | |
|---|---|---|---|---|
| GB | 611032 | 10/1948 | ..... | 205/45 |

*Primary Examiner*—Stephen Husar
*Assistant Examiner*—phen Tsidulko
(74) *Attorney, Agent, or Firm*—Drinker Biddle & Reath LLP

(57) ABSTRACT

The invention concerns an illuminating spotlight emitting a narrow beam. The spotlight has a highly concentrated light source and a concave reflector for emitting an illuminating beam in a specific direction, along an emitting axis. A converging lens is interposed between the source and the reflector and in a plane passing through a conical segment. The source is bordered laterally on the reflector side with a sector of the converging lens providing a virtual image of the source located beyond the emitting axis, on the side opposite that of the lens. The virtual image of the light source is formed at the focus of the conical segment locally defining the reflector.

10 Claims, 12 Drawing Sheets

ILLUMINATING SPOTLIGHT PROJECTOR AND LIGHTING INSTALLATION WITH OFFSET LIGHT SOURCE

The present invention relates to an illuminating spotlight emitting a narrow beam, comprising a highly concentrated light source and a concave reflector for emitting an illuminating beam in a given direction, along an axis of emission.

The invention relates also to a lighting installation produced using such a spotlight.

In order to control the distribution of the lighting in an area or more generally, at a site, it is in many cases valuable to have a beam of very precise angular definition. That means that the aperture angle of the beam must be very small.

In general, the beam is a luminous beam of rays that are in theory parallel, which beam is obtained by a parabolic reflector whose focal point corresponds to the light source of the bulb and whose axis is the axis of emission. Part of such a spotlight is shown in diagrammatic section in FIG. 1.

However, the rays that are emitted do not form a totally parallel beam because the light source is neither a point source nor a monochromatic source.

Accordingly, only the beams that are emitted by the source located at the focal point F and strike the reflector represented by the segment of a parabola UP generating it are emitted in the form of relatively parallel rays. All the rays contained within the cone of axis X'X and of half-angle δo/2, of generating line FP passing the edge of the reflector, are emitted directly in the form of rays that are radial and not parallel to the axis X'X.

In practice, such a reflector is formed by a portion of a paraboloid of revolution of axis X'X, of focal point F and defined by its parameter p, its forward opening radius R2 and its rearward opening radius R1 (the rearward opening serves for the passage of the lamp). The flux used increases when the radius R2 increases, and it is considered to be at its maximum when the characteristics of the reflector are such that:

$$p=\sqrt{R_1 * R_2/2}$$

The angle γ of the captured flux is delimited by the contour UP of the reflector. The development of a more enveloping reflector would result in excessive dimensions. It must also be noted that the lamps have large dimensions relative to the reflector, and the real focal point necessarily extends beyond the theoretical focal point, which is the main cause of the lack of parallelism mentioned above. The divergence increases with the dimensions of the source or vice versa, if the focal distance diminishes and the diameter of the reflector diminishes relative to that of the source. The positioning of a lens in front of the opening face of the reflector might be considered, but it would correct not only the direct flux but also the flux of parallel rays reflected by the reflector.

In conclusion, the correction provided by a lens positioned at the front would not be very effective.

Finally, it must be noted that the effective angle of emission of a beam is very much greater than the angle attributed to, a light source equipped with a reflector, such as, for example, halogen bulbs equipped directly with a reflector. That angle is defined as being the angle of emission of 50% of the luminous flux, the remainder of the flux being emitted in directions that are not contained within that cone of emission. The definition of the angle of illumination appears in FIG. 1A, which shows the separation graph of the luminous intensity as a function of the angle relative to the axis X'X (FIG. 1) That distribution is a bell curve, and the angle of the spotlight is the angle giving, by definition, the intensity greater than the half-average IM/2 relative to the maximum intensity IM in the direction of the axis (α=o). The angle α attributed to the beam is thus obtained, in which angle the flux should be the maximum.

In practice, that means that the beam is not very precise at all.

The object of the present invention is to develop a spotlight allowing the emission of a beam that has a very small angle and that groups together almost all of the luminous flux emitted by the source.

To that end, the invention relates to a spotlight of the type defined above, characterised by

- a convergent lens positioned between the source and the reflector,
- in a plane passing through the axis of emission,
- the concave reflector formed by a conic section (ellipse or parabola),
  - the source is bordered laterally on the side of the reflector by a sector of the convergent lens giving a virtual image of the source, which virtual image is situated beyond the axis of emission, on the other side from the lens,
  - the virtual image of the light source being formed at the focal point of the conic section locally defining the reflector.

In an advantageous manner, the reflector comprises a body of revolution about the axis of emission XX. According to the circumstances, the conic is a parabola whose axis is parallel to the axis of emission.

Thanks to the displacement of the light source by its virtual image, it is possible to have a sector of a parabola of relatively large focal distance, that is to say a highly enveloping sector of a parabola.

It receives all the luminous flux transmitted by the peripheral lens. Since the lens is itself highly enveloping, a large fraction of the emitted flux thus passes through the lens to be reflected, by the reflector, in the form of rays that are almost parallel.

Only the light rays emitted within the solid angle represented by the source and the rear edge of the lens are directed to the rear without being recovered. In general, those rays avoid the optical system formed by the peripheral lens and have a random orientation. The corresponding, frontal part for the solid angle defined by the frontal edge of the peripheral lens, and the vertex of which is the light source, is emitted directly.

According to an advantageous feature, the forward opening of the peripheral lens is occupied by a lens whose focal point corresponds to the light source, so that that lens emits a beam of rays that are parallel to the axis of emission XX. That luminous flux is added to the luminous flux returned by the reflector.

In that manner, almost all of the luminous flux of the source is recovered in the form of a beam of parallel rays, that is to say, in practice, of rays that are very slightly divergent. The solid angles of emission γ and δ are totally controlled. Only the rear angle of emission β corresponds to flux of which a portion will be absorbed.

In an advantageous manner, the peripheral lens and the frontal lens are produced in a single piece or constitute a single piece by the assembly of two lenses produced separately. The reflector is preferably made of glossy polished aluminium or of vacuum metallised plastics material, or of glass with reflective dichroic metallisation with, for example, titanium oxide.

According to another feature of the invention, the reflector is generated by an arc of an ellipse whose second focal point is located on the axis of emission.

The invention relates also to a lighting installation composed of a spotlight as defined above and of at least one mirror forming a lighting system having an offset focal point, for illuminating an area for illumination that the spotlight cannot reach directly.

Under such conditions, the spotlight can be installed in a location that is readily accessible; that area can also be accessible on account of the power supply that exists in the location or that is easily brought to the location, without requiring the complex installation in certain cases of cables such as for illumination with a direct spotlight.

Thanks to the very precise pencil of rays formed by the spotlight, it is simple to aim at a deflection mirror, even such a mirror located at a relatively great distance from the spotlight, without giving rise to the considerable loss of luminous flux passing to the side of the mirror or without requiring a large-sized returning mirror. On the contrary, it is possible to use mirrors which are small in size, are light-weight and are simple to produce and install.

Since the mirror is generally turned with its reflecting face downwards, there is no risk of its reflecting surface becoming covered with dust or deposits, so that it requires virtually no maintenance.

According to a particularly interesting feature, the mirror is formed by a plate forming the reflector, which plate is fixed to a sleeve connected by means of a deformable rod to a foot.

According to another particularly interesting feature, the mirror is formed by a support carrying along its outer periphery a reflector held in its centre by means of an adjustable screw that is connected to the support and adjusts the curvature of the reflector.

The present invention will be described in greater detail below with the aid of the attached drawings, in which:

FIG. 1 is a skeleton diagram of a known spotlight having a parabolic reflector, FIG. 1A is a graph showing the distribution of the luminous intensity of a known spotlight according to FIG. 1, FIG. 2 is a skeleton diagram of a spotlight according to the invention, FIG. 3 is a more complete view of an embodiment of a spotlight, at the level of the lenses, FIG. 4 is an overall diagram of a spotlight, FIG. 5 is an axial cutaway view of a first element of the spotlight, FIG. 6 is an axial cutaway view of the spotlight element equipped with its lamp socket, FIG. 7 is a diagram of a lighting installation having an offset focal point according to a first embodiment, FIG. 8 is a diagram of a lighting installation having a plurality of offset spotlights and a plurality of mirrors according to the invention, FIGS. 9, 9A, 10 and 10A are enlarged side views and detailed views, respectively, of two embodiments of mirrors according to the invention, FIG. 11 shows a detail of a mirror fixing, FIG. 12 is a front view of a mirror according to the invention, FIGS. 13 and 14 are cutaway views of two other types of mirror according to the invention, FIG. 15 is a cutaway view of a mirror of adjustable curvature, FIG. 16 shows a system having a plurality of mirrors, FIG. 17 shows several forms of mirror, FIG. 18 is a diagrammatic view of a plurality of mirrors supplied by a single spotlight, FIG. 19 shows an assembly of a plurality of mirrors, FIG. 20 is a perspective view of a single mirror of rectangular shape, FIG. 21 is a perspective view of a single mirror of octagonal shape, FIG. 22 is a cutaway view of the installation of a mirror according to FIG. 20 or 21, FIG. 23 is a cutaway view of the installation of a plurality of mirrors of the type of FIGS. 20 and 21.

A spotlight according to the invention will be described below with the aid of the diagram of FIG. 2.

The spotlight is intended to emit a narrow beam. It comprises a light source S which is housed in a bulb (not shown) and is considered effectively to be a point source.

The source S, situated on the axis of emission XX, that is to say the axis along which the beam is to be directed, emits in the solid angle surrounding it.

In order to simplify the drawing and the explanations, FIG. 2 shows only part of an axial section, or supposed axial section, of the spotlight through a plane passing through the axis of emission XX.

The source S is bordered on one side of the half-plane delimited by the axis of emission XX by a convergent lens LA, shown only in section. The lens has a focal distance that is greater than the distance (d) separating it from the source S, in order to produce a virtual image S' of the source S, which virtual image is situated in the half-plane other than that of the lens LA, relative to the axis of emission XX.

Beyond the lens LA there is a concave reflector R defined by a conic section (ab) of which one or the focal point F coincides with the virtual image S' of the light source S. The length of the section (ab) is chosen to cover the entirety of the beam that is emitted by the source S and has passed through the lens LA.

According to the properties of conics, the rays r1, r2 and all the intermediate rays, reflected by the reflector RF and coming from the source S, are directed towards the second focal point of the conic, which may be the second focal point of the ellipse located on the axis of emission XX or the focal point shifted to infinity in the direction of the axis of emission XX if the conic section (ab) belongs to a parabola of axis $X_1X_1$ and of focal point F.

In order also to recover the rays emitted by the solid angle $\delta$ corresponding to the cone resting on the edge LA2 of the lens LA and whose vertex is the source S, there is provided a convergent frontal lens LF which is located against the edge LA1 of the lens LA and the focal point of which coincides with the source S. The lens LF will then emit rays r3, r4 that are parallel to the axis XX.

In that manner, all the rays emitted by the source S in the peripheral angle $\gamma$ and the frontal angle $\delta$ will be transformed into rays that are parallel or substantially parallel to the axis XX.

In general, the lens LA, of which a segment is shown in FIG. 2 in the form of a section of the lens through a plane resting on the axis XX, is a lens of revolution of axis XX. Under those conditions, the conic section (ab) also defines a surface generated by the rotation of the section (ab) about the axis XX (and not the axis $X_1X_1$). Under such conditions there is not a paraboloid but a pseudo-paraboloid.

FIG. 3 is a diagrammatic view of a spotlight according to the invention showing the monobloc form of a combined lens 1 combining the annular lens LA and the frontal lens LF.

Only the filament constituting the source F of the bulb has been shown. This figure also shows the reflector 3 and the outline of the casing 6 of the spotlight.

This figure corresponds to a spotlight having a form of revolution about the axis of emission XX. The various angles of emission γ, δ have been shown, as has the angle of emission towards the rear β.

FIG. 4 is an axial cutaway view of a practical embodiment of a spotlight according to the invention comprising a lens 1 housing a halogen bulb 2 inside the reflector 3 carried by a ring 31 equipped with resilient tongues 32 which enter the annular throat 11 of the lens 1. The reflector 3 is also fixed to the ring 31 by its turned-in base 33, optionally crimped according to a peripheral crown 34 (FIG. 5) in a peripheral throat 35 of the ring 31. The assembly formed by the lens 1, the bulb 2 and the reflector 3 constitutes a product that is manufactured as such and cannot be dismantled.

FIG. 4 also shows the particular form of the frontal lens, which is in fact composed of an annular portion 12 and an axial portion 13 in order to form a housing 14 that receives the tip 21 of the bulb 2 in the case where the lens is separate from the bulb forming the lamp, the body of the bulb itself being housed in the cavity 15 defined principally by the inner contour of the annular lens. The assembly so produced can be completed to the rear by a centring lamp socket 40 in which there engage the pins 22 of the bulb 2. The lamp socket is itself integrated in a seal 41 through which the contact pins 42 pass. The contact pins are intended to be accommodated in the contact block 5, which is itself connected to the power supply.

The assembly described above is housed in a casing 6 of the spotlight which is connected in an orientable manner to a foot 7; rotational locking is effected with the aid of a screw 61 which presses against the outer contour of the joining piece 71 of the foot 7. The other installation means for the spotlight are not shown.

FIG. 5 shows the sub-assembly formed by the lens 1, the bulb 2, the reflector 3 and the ring 31.

FIG. 6 shows the complete sub-assembly formed by a sub-assembly analogous to that of FIG. 5, completed by the lamp socket 40 and the base 41 with the pins 42 passing through.

FIG. 7 shows diagrammatically a first embodiment of a lighting installation having an offset light source (or light focal point) according to the invention. The installation is intended to illuminate an object or a surface SE in a very limited and precise manner. To that end, a spotlight P forming the light focal point according to the invention is installed close to a power supply A at a readily accessible height H. The installation also comprises a mirror M, which is orientable, towards which the beam F of angle α is directed; the mirror, oriented in the appropriate manner, sends back a beam of angle α1 to illuminate the surface SE. The angle α1 is equal to the angle α if the mirror M is plane. Otherwise, the angle is different. It may be greater than or less than the angle α according to the curvature of the mirror M.

FIG. 8 is a plan view of an installation having a plurality of spotlights P1–P6 and a plurality of associated mirrors M1–M6, one mirror being associated with each spotlight. The beams reflected by the mirrors M1–M6 bear the references α1–α6.

This figure shows one of the advantages of the lighting installation having offset source(s) according to the invention, because it allows the spotlight to be grouped, for example, in two groups, one containing spotlights P1, P2, P3 and the other containing spotlights P4, P5, P6. The mirrors can be positioned anywhere within the space, so as to be as unobtrusive as possible and to permit the best illumination of the surface to be illuminated; the latter is not shown in this figure. The surface to be illuminated can be composed of a plurality of elements each illuminated separately by one mirror.

As will be seen hereinbelow, the important factor with regard to the mirrors is that they should be as light-weight, unobtrusive and orientable as possible so that they can be installed simply and unobtrusively in the most appropriate locations.

Various examples of mirrors will be described below.

Accordingly, FIGS. 9, 9A show a first embodiment of a mirror 100 formed by a convex reflecting surface 101 that is fixed in its centre to a sleeve 102 by means of a screw 103. The sleeve is itself fixed to a deformable rod 104 carried by a tube 105 that is fixed to a foot 106. The foot 106 has, for example, on its rear face, a mechanical fastener 107 or two adhesive pads 108 as is shown in FIG. 11. The connection between the sleeve 102 and the deformable rod 104 is made, for example, with the aid of a screw 109 carried by a manoeuvring rod 110. The screw 109 compresses the end of the rod 104, which may be a power cable rigidly connected to a conductor, for example of 1.5 mm or 2.5 mm in section, which has the advantage of being very readily deformable and of retaining the deformation.

The reflecting surface 101 of the mirror is made with the aid of the rod 110, which is held in the hand and manoeuvred in order to direct the reflected luminous beam.

FIG. 9A shows the detail of the assembly between the sleeve 102, the reflector 101 with the central screw 103, the end of the rod 104, and the screw 109 carried by the end of the manoeuvring rod 110. In this embodiment, the end of the rod 104 is introduced transversely into the housing of the sleeve 102, and the screw 109 is screwed in the axial direction.

The variant of the mirror 200 according to FIG. 10 corresponds substantially to the embodiment of FIGS. 9, 9A except that the deformable rod 204 enters the sleeve 202 along the axis, and the screw 209 is screwed radially. The other elements forming that mirror are analogous to, if not identical with, those of the mirror 100 and bear the same reference numerals increased by 100.

Unlike the mirror 100, the mirror 200 does not have a tube 105, and the flexible or deformable rod 204 connects the sleeve 202 to the plate 206. The element 205 fixing the deformable rod 204 to the plate 206 can be constructed analogously to the element 202. The element 205 can be fixed to the plate 206 from behind with the aid of a screw, and the rod 204 can be fixed thereto, as in the sleeve 202, by means of a screw (not shown).

The means for fixing the plate 206 to the support (wall, ceiling or object) are the same as those for fixing the plate 106 shown in FIG. 11.

FIG. 12 shows a front view of a mirror 250 with an irregular contour 251 surrounding the surface 252 of the reflector. The reflector has a central fastener 253 in the form of a screw. The irregular contour 251 is intended to conceal the mirror or integrate it in an assembly.

FIG. 13 is a cutaway view of a mirror 260 of which there are shown only the support 261, which carries the reflector 262 in the form of a sandwich structure, as well as the deformable rod 263 for orienting the mirror.

FIG. 14 shows, in a cutaway view, another form of mirror 270 having a support 271 in the form of a sleeve which is connected to the deformable support rod 273. The actual reflector 272 is surrounded by a frame, for example a U-shaped profile, 274.

FIG. 15 shows a mirror 280 of adjustable curvature. The mirror is composed of a sleeve 281 carrying a support 282 which forms the underframe of the reflector and carries the reflector 283 along its outer periphery. In its centre, the reflector 283 is held by a screw 284 lodged in a threaded portion of the sleeve 281. By tightening the screw more or less, the reflecting surface 283 is bent more or less from the plane or almost plane shape shown by the broken line. The sleeve 281 is also carried by a deformable rod 285.

FIG. 16 shows a system formed by three mirrors 290, 291, 292 which are intended for three separate spotlights or to receive the single beam from the same spotlight but deflect parts of the beam in different directions. Those reflectors 290, 291, 292 are connected by means of deformable rods 293, 294, 295 to a common support plate 296 provided with fixing means (not shown).

FIG. 17 shows three forms of reflectors 300, 301, 302 which are, respectively, circular, rectangular with rounded corners, and octagonal. Those reflectors can be used to equip the mirrors described above.

FIG. 18 shows an assembly of three mirrors 350, 351, 352 receiving a common beam and returning parts of that beam in three different directions, as is shown by broken lines. The mirrors 350, 351, 352 are carried by deformable rods 353, 354, 355 on a curved support 356 which is fixed to a curved support such as a panel 357. Such an installation can be produced according to any desired orientation on a vertical, horizontal or inclined support 257.

FIG. 19 shows a support rail 360 carrying four mirrors 361, 362, 363, 364 which are fixed in an adjustable manner to the rail, which is itself provided with fixing means 365, 366. The rail 360 may be a simple straight rod or a frame 367 such as that shown completely by the broken line.

FIG. 20 shows a perspective view of a particularly interesting embodiment of a mirror 400 which is formed by a reflector 401 and a support 402 connected to the reflector by a leg 403. The assembly may be cut from a metal sheet and bent as shown.

Because the bent parts are not rigid, it is possible to deform the connection 403 once the tab 402 has been fixed in the appropriate location, in order to orient the reflector 401 as desired.

Figure 1:
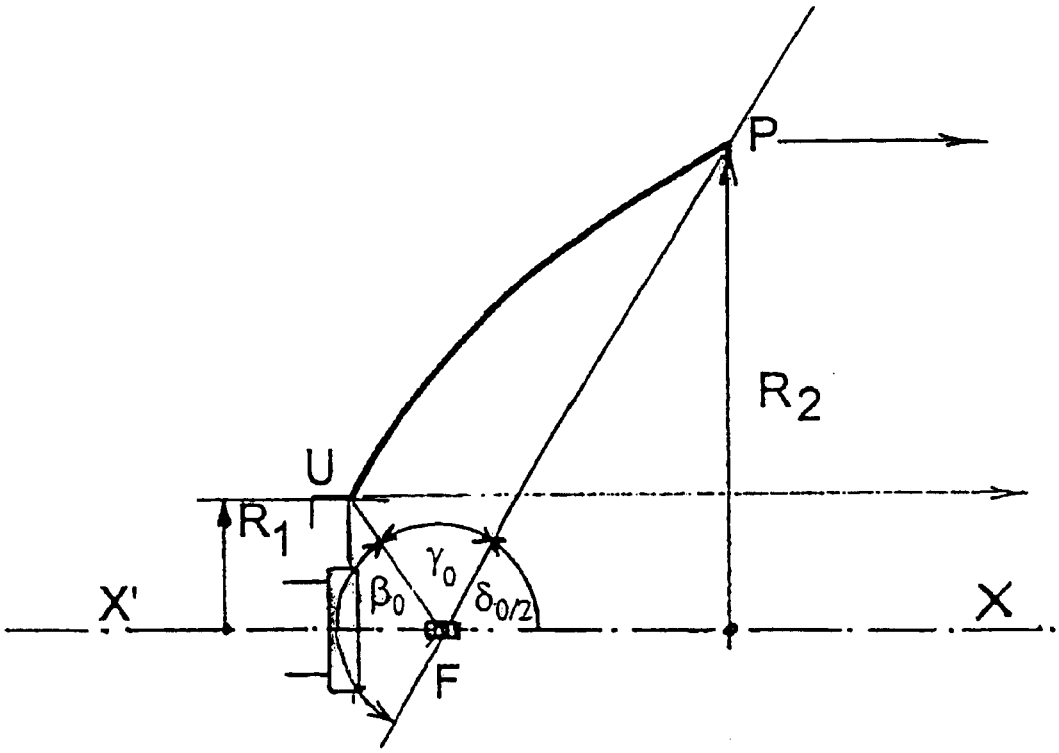
Figure 1A:
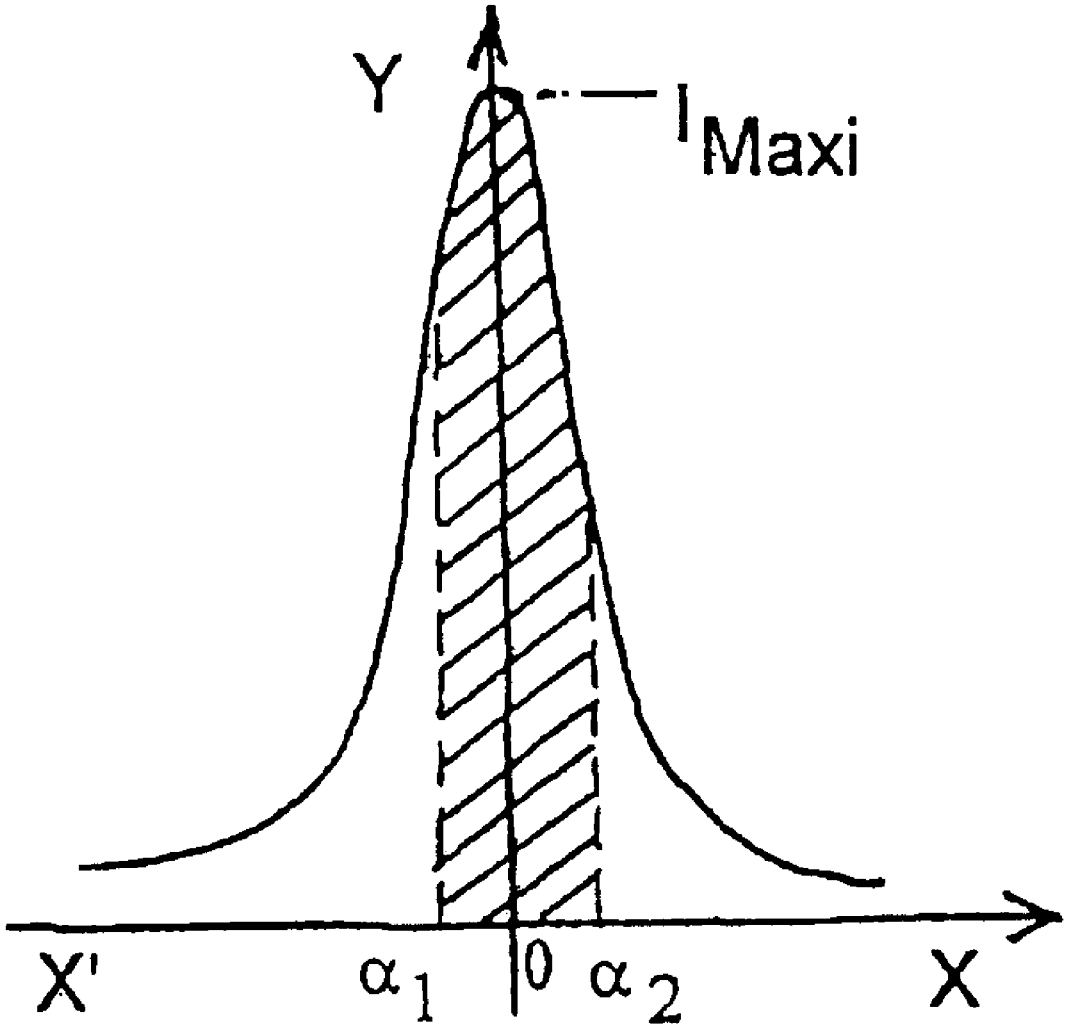
Figure 2:
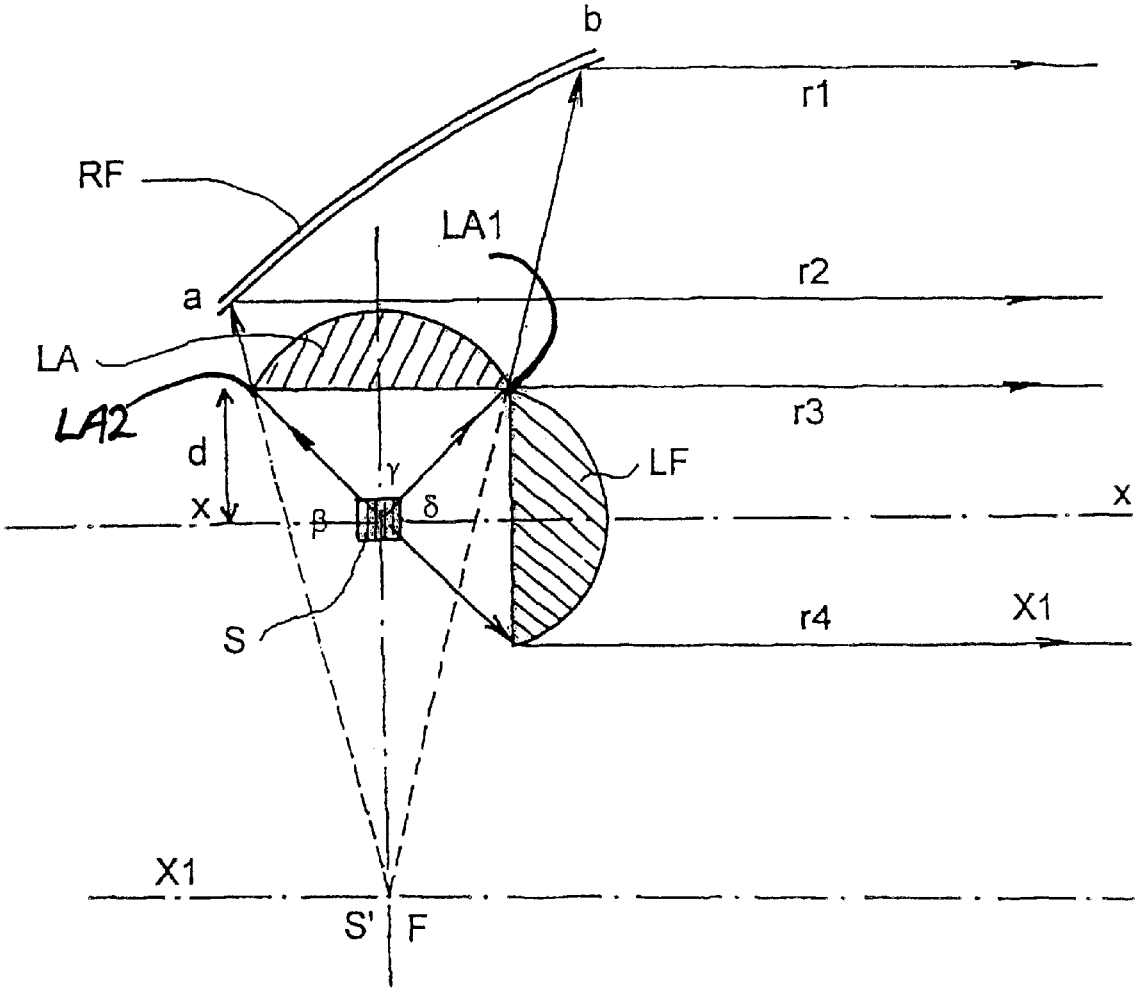
Figure 3:
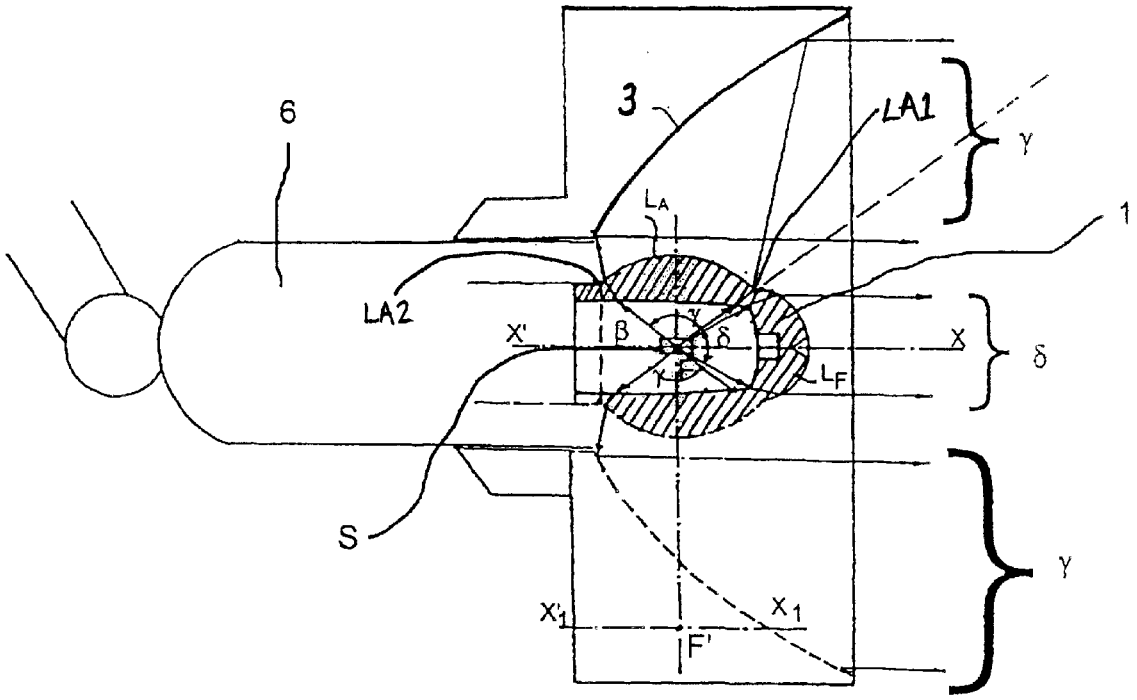
Figure 4:
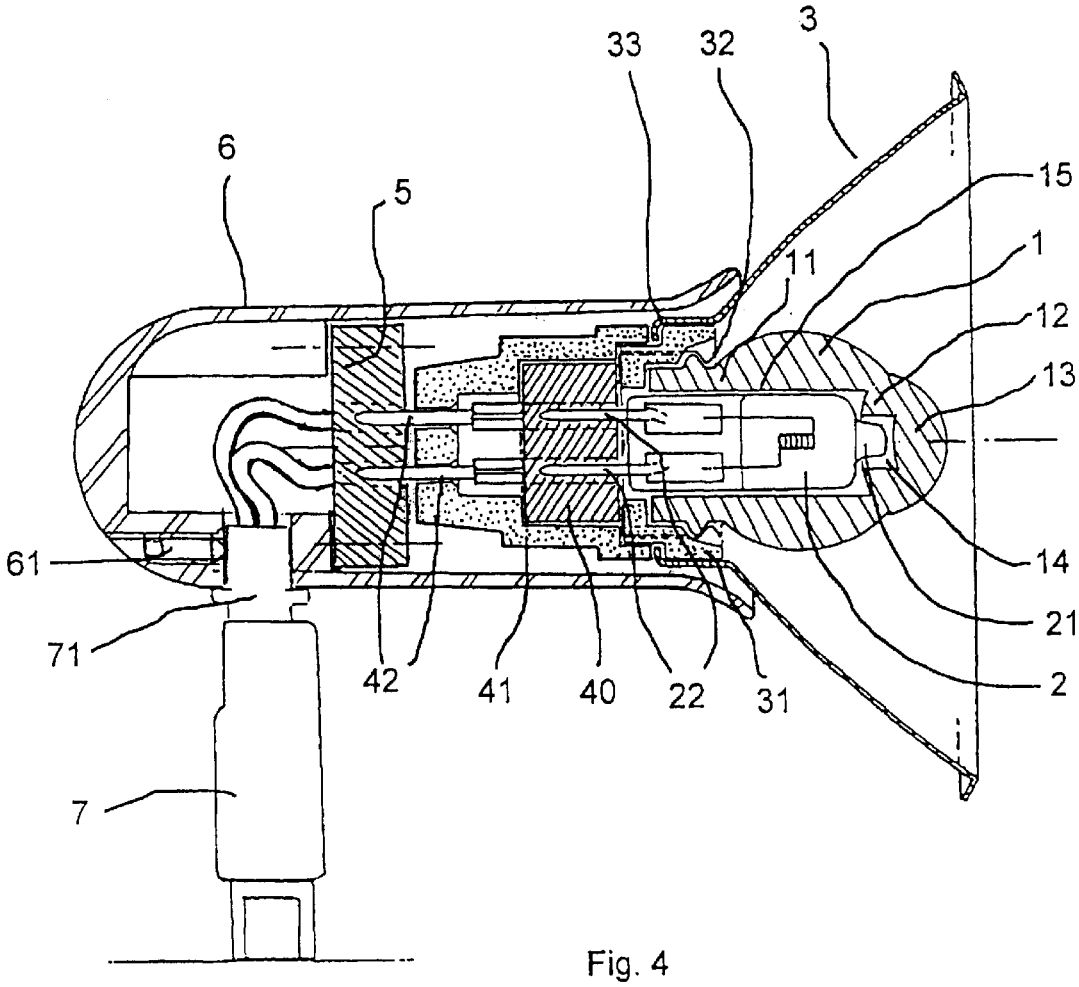
Figure 6:
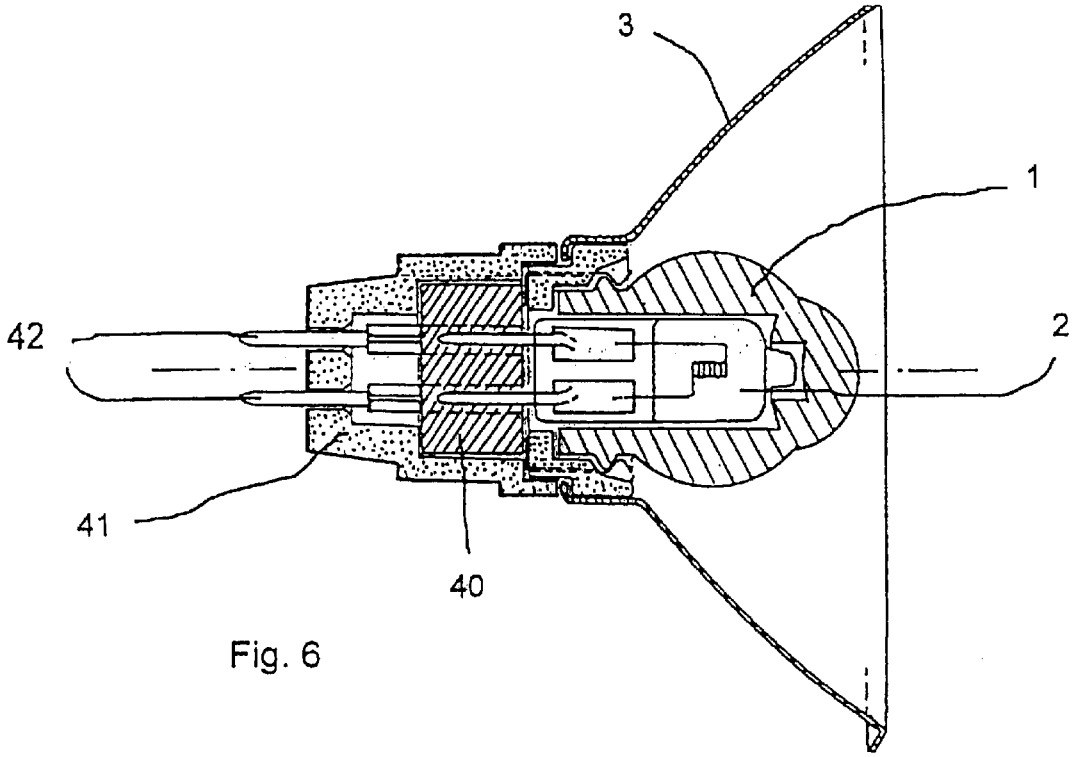
Figure 5:
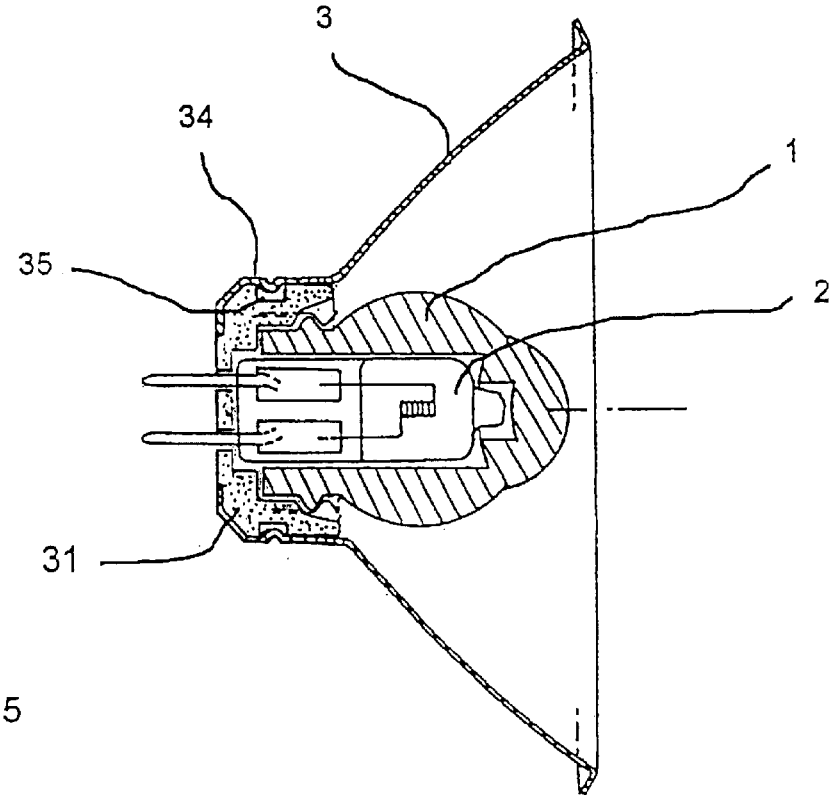
Figure 7:
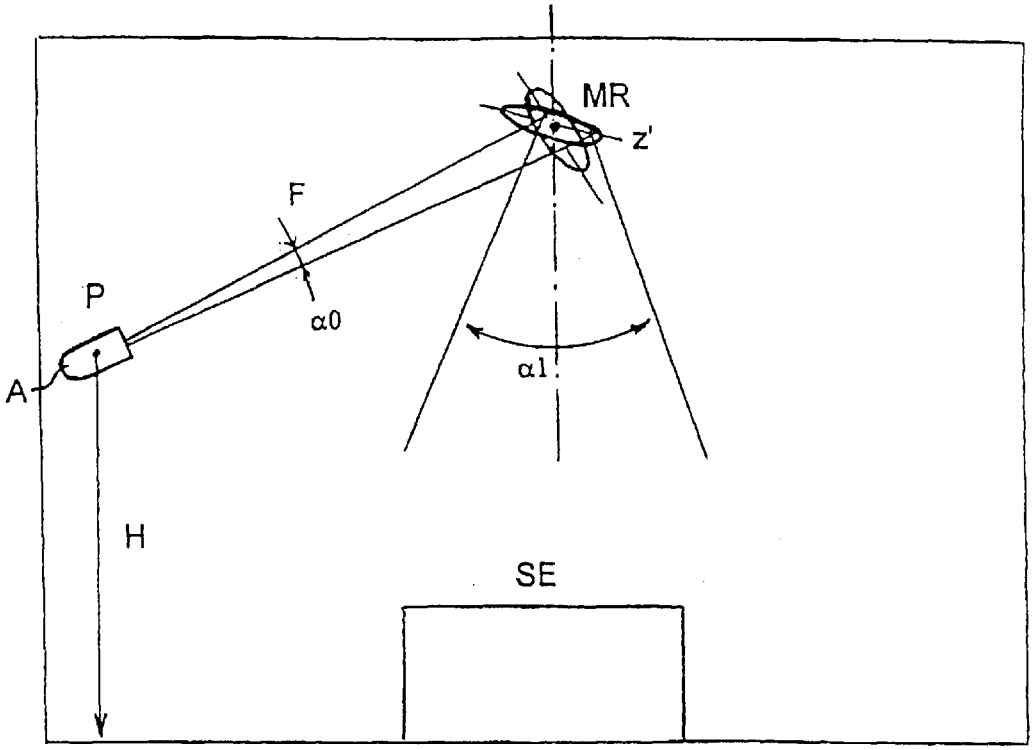
Figure 8:
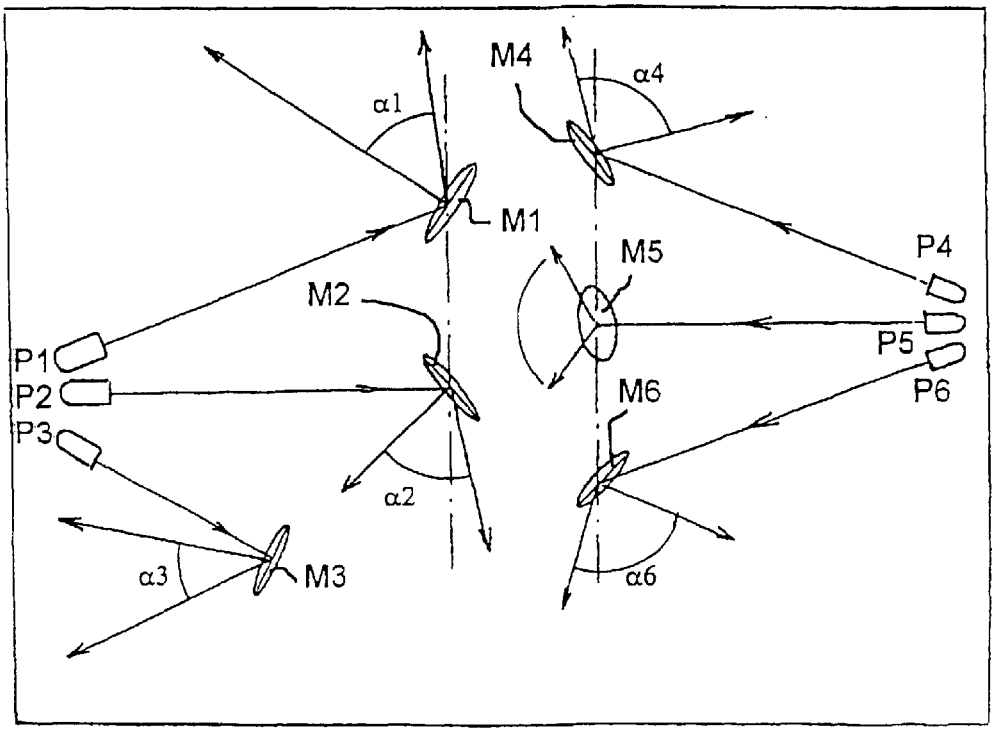
Figures 9, 9A, 10, 10A, 11:
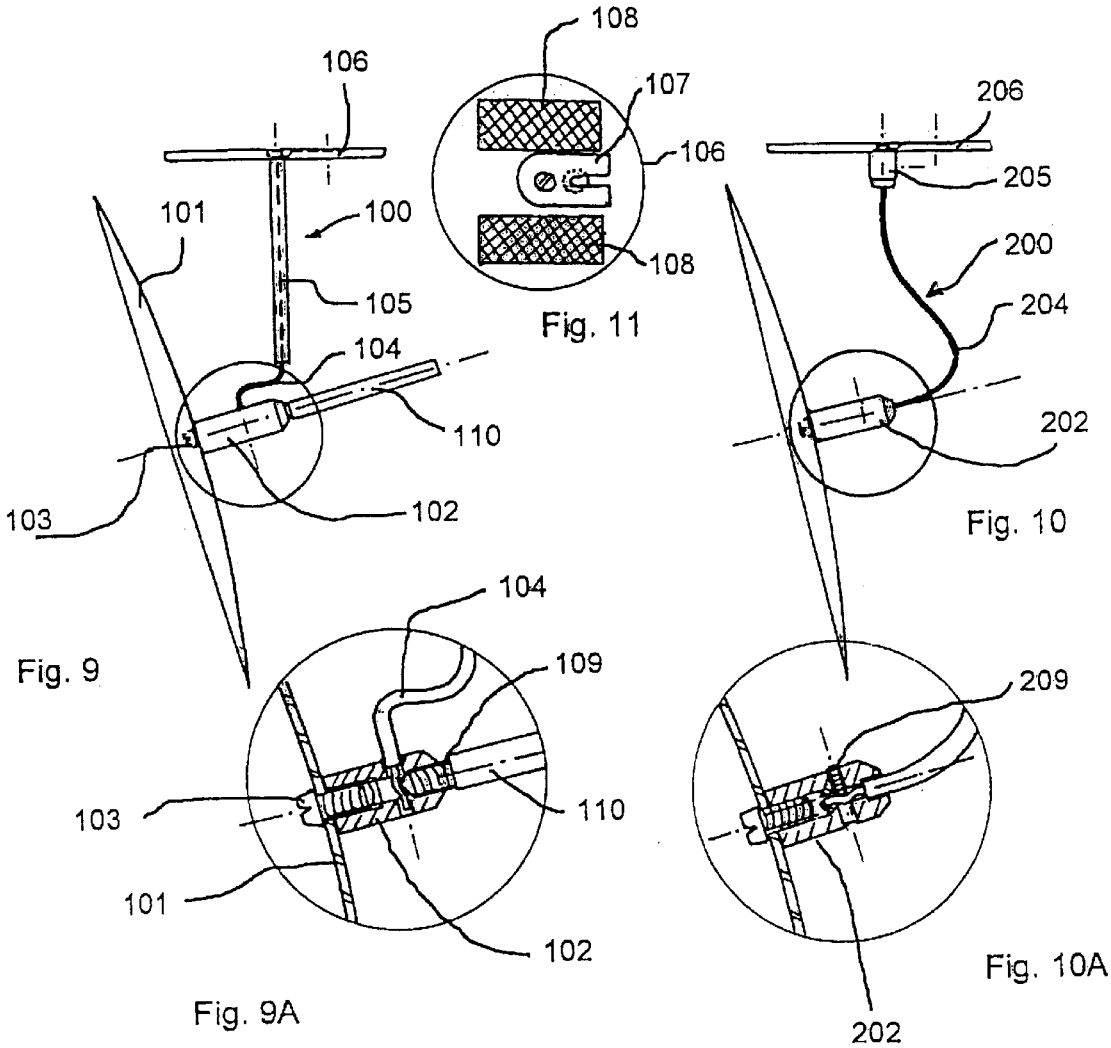
Figure 12:
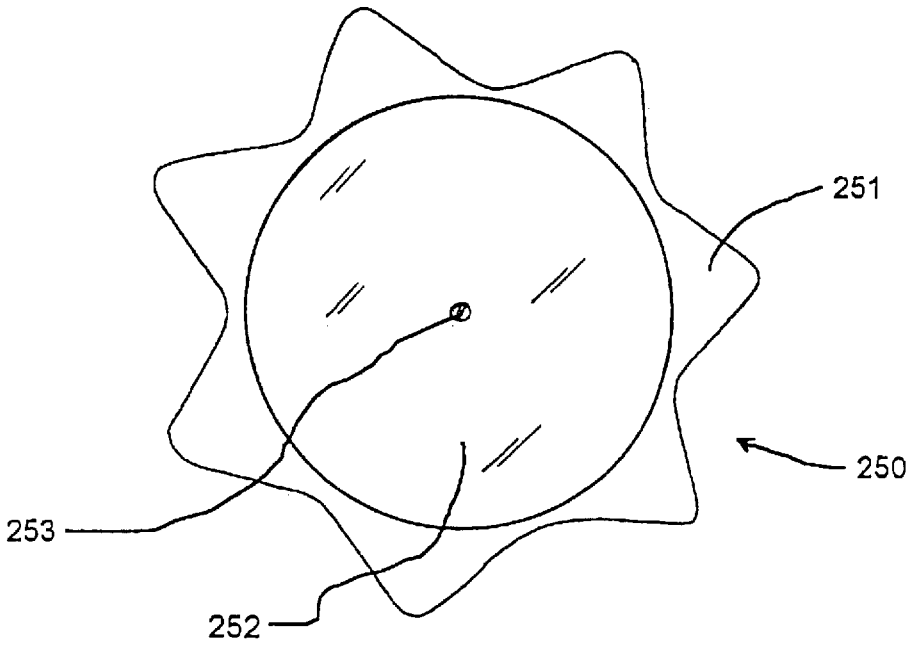
Figure 13:
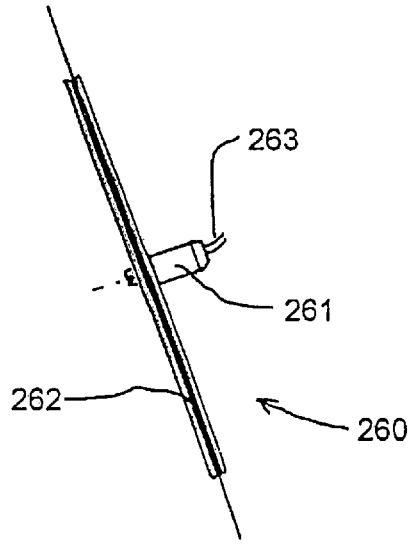
Figure 14:
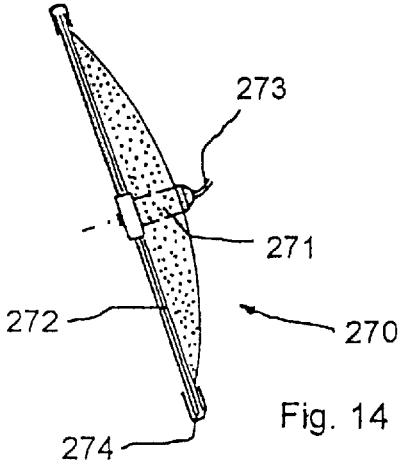
Figure 15:
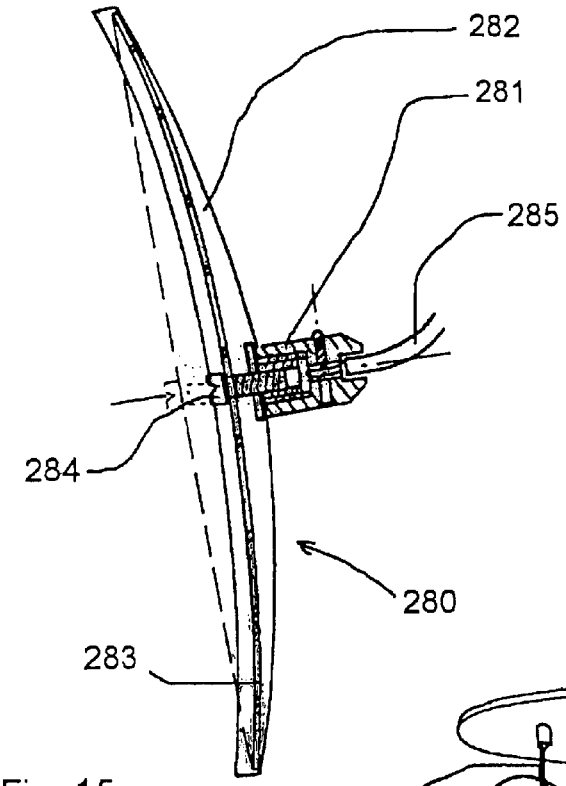
Figure 16:
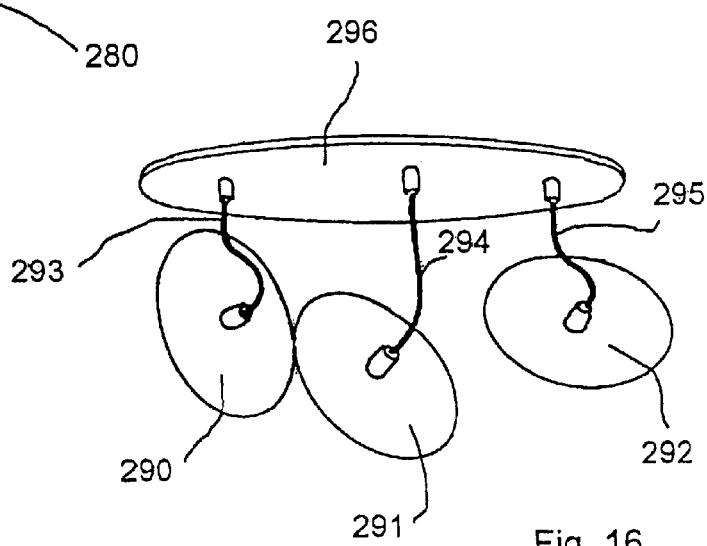
Figure 17:
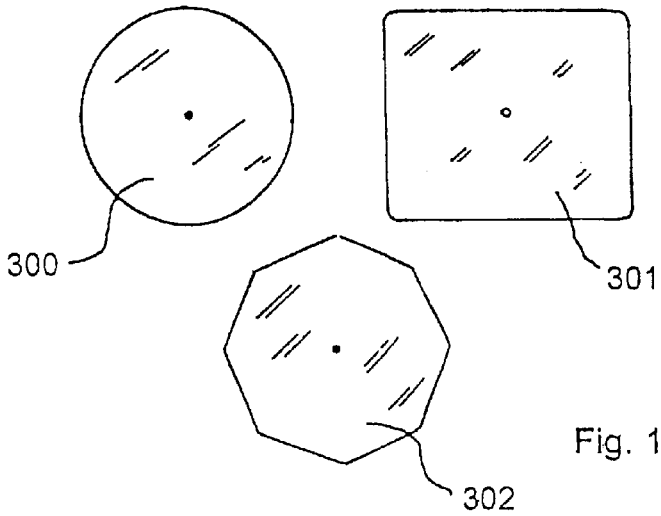
Figure 19:
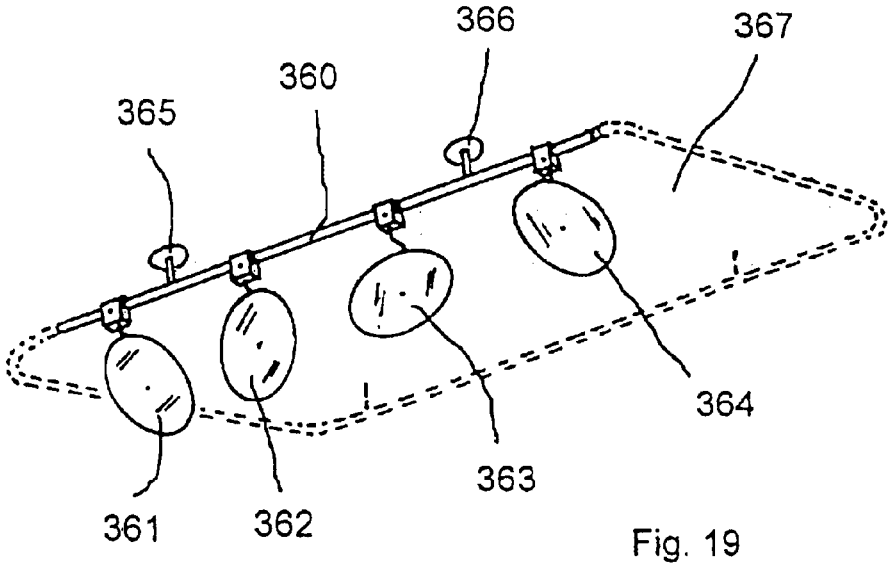
Figure 18:
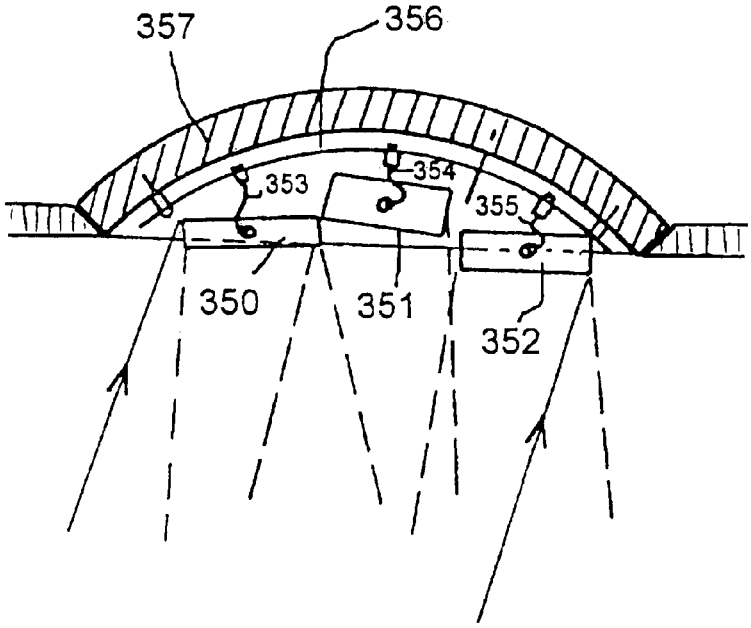
Figure 20:
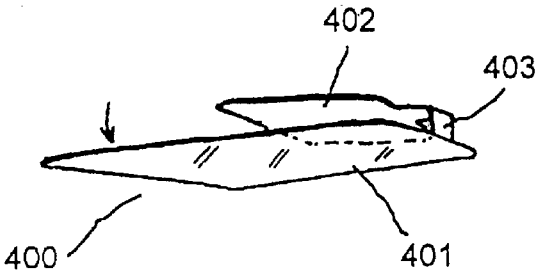
Figure 21:
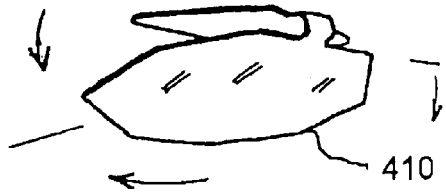
FIG. 21 shows a reflector 410 which is analogous to the reflector 400 of FIG. 20 except that it is octagonal and not rectangular in shape.
Figure 22:
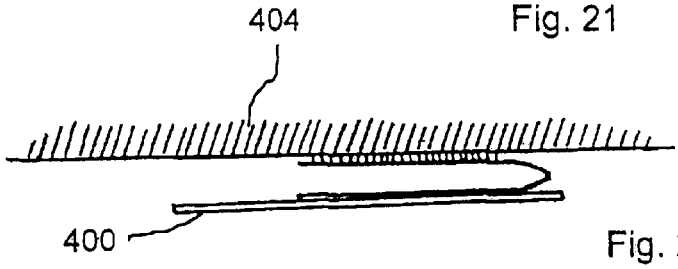
FIG. 22 is a cutaway view of the reflector 400 showing its fixing to a support 404.
Figure 23:
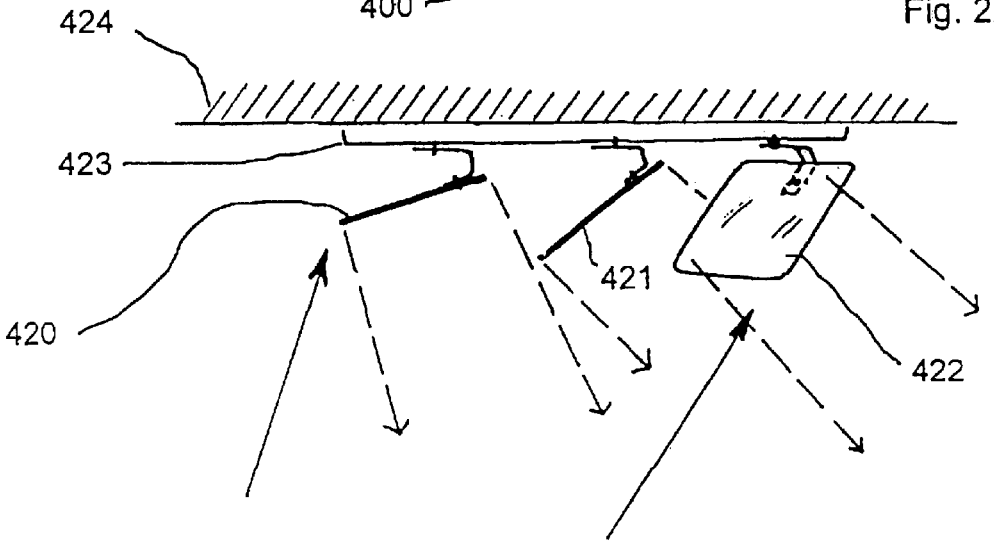

FIG. 23 is a diagrammatic side view of an assembly of three reflectors 420, 421, 422 of the type of FIG. 20, which assembly is fixed to a common support 423 that is itself fixed to a ceiling, a wall or the like 424.

According to a variant which is not shown, some or all of the lenses of the spotlight are Fresnel lenses.

What is claimed is:

1. Illuminating spotlight emitting a narrow beam, comprising a highly concentrated light source and a concave reflector for emitting an illuminating beam in a given direction, along an axis of emission characterised by a convergent lens positioned between the source and the reflector, and in a plane passing through the axis of emission:

the concave reflector is being defined locally by a conic section, the source is being bordered laterally on the side of the reflector by a sector of the convergent lens giving a virtual image of the source, which virtual image is situated beyond the axis of emission, on the other side from the lens, the virtual image of the light source being formed at the focal point of the conic section locally defining the reflector.

2. Spotlight according to claim 1, characterised in that, the spotlight comprises a body of revolution about the axis of emission (XX).

3. Spotlight according to claim 1, characterised in that the conic section is an ellipse whose second focal point is located on the axis of emission.

4. Spotlight according to claim 1, characterised in that the conic section is a parabola whose axis is parallel to the axis of emission.

5. Spotlight according to claim 2, characterised in that the frontal opening left by the body of revolution (LA) around the axis of emission (XX) is occupied by a convergent lens (LF) whose focal point corresponds to the light source (S).

6. Spotlight according to claim 2, characterised in that the lens is in a single piece and houses the lamp forming the light source.

7. Spotlight according to claim 1, characterised in that the angle of coverage ($\gamma$) of the peripheral lens corresponds to the length of the conic section defining the reflector.

8. Lighting installation having an offset light focal point, characterised by a narrow beam emitting spotlight, comprising a highly concentrated light source and a concave reflector for emitting an illuminating beam in a given direction, along an axis of emission and having a convergent lens positioned between the source and the reflector, and in a plane passing through the axis of emission:

the concave reflector being defined locally by a conic section, the source being bordered laterally on the side of the reflector by a sector of the convergent lens giving a virtual image of the source, which virtual image is situated the concave reflector being defined locally by a conic section, the source being bordered laterally on the side of the reflector by a sector of the convergent lens giving a virtual image of the source, which virtual image is situated beyond the axis of emission, on the other side from the lens, the virtual image of the light source being formed at the focal point of the conic section locally defining the reflector, and at least one mirror located in the axis of emission and directing the light towards die surface to be illuminated.

9. Lighting installation according to claim 8, characterised in that the mirror (100) is formed by a plate (101) forming the reflector, which plate is fixed to a sleeve (102) that is connected by a deformable rod (104) to a foot (106).

10. Lighting installation according to claim 8, characterised in that the mirror (280) is formed by a support (282) carrying along its outer periphery a reflector (283) held in its centre by an adjustable screw (284) that is connected to the support and adjusts the curvature of the reflector (283).

* * * * *